United States Patent [19]

Patel et al.

[11] Patent Number: 4,796,483

[45] Date of Patent: Jan. 10, 1989

[54] COLD-FORMED ROCKER ARM WITH CAM-CONTACTING ROLLER

[75] Inventors: Ramanlal L. Patel, Spartanburg, S.C.; Jesse V. Mills, Toledo, Ohio

[73] Assignee: The Henley Group, Inc., La Jolla, Calif.

[21] Appl. No.: 95,129

[22] Filed: Sep. 11, 1987

[51] Int. Cl.[4] ..... F01L 1/18

[52] U.S. Cl. ..... 74/519; 74/559; 29/156.4 R; 123/90.39; 123/90.44; 123/90.36

[58] Field of Search ..... 74/519, 523, 559; 123/90.39, 90.41, 90.42, 90.44, 90.5; 29/156.4 R, 156.7 B

[56] References Cited

U.S. PATENT DOCUMENTS

| | | | |
|---|---|---|---|
| 1,699,657 | 1/1929 | Fagan | 123/90.39 |
| 2,345,822 | 4/1944 | Leake | 123/90.39 |
| 2,811,959 | 11/1957 | Etchells | 123/90.36 |
| 2,824,554 | 2/1958 | Sampietro | 123/90.39 |
| 3,376,860 | 4/1968 | Johnson et al. | 123/90.44 |
| 4,182,290 | 1/1980 | Pohle | 123/90.39 |
| 4,517,935 | 5/1985 | Pomfret | 123/90.4 |
| 4,614,171 | 9/1986 | Malhotra | 123/90.44 |
| 4,653,441 | 3/1987 | Belsanti | 74/519 X |
| 4,674,453 | 6/1987 | Dove | 74/519 X |
| 4,697,473 | 10/1987 | Patel | 74/519 |

FOREIGN PATENT DOCUMENTS

| | | | |
|---|---|---|---|
| 0112320 | 9/1978 | Japan | 123/90.44 |

*Primary Examiner*—Gary L. Smith
*Assistant Examiner*—Vinh Luong
*Attorney, Agent, or Firm*—Allen D. Gutchess, Jr.

[57] ABSTRACT

A one-piece, cold-formed rocker arm of the cam follower type is provided. The rocker arm includes a one-piece metal body cold formed from a metal blank and being of U-shaped cross section substantially throughout its length. The body has a bottom wall with upstanding, structurally-integral side walls. An intermediate, convex portion of the bottom wall has a rectangular opening therein extending therethrough. A cam-contacting roller is rotatably mounted on an axle carried by the side walls above the rectangular opening. The roller has a circumferential surface positioned to engage a cam above the rocker arm. The rocker arm body has a downwardly-extending pin with a rounded end to receive a lifter post on which the rocker arm can pivot. The pin is affixed to the bottom wall at one end portion of the rocker arm body. The bottom wall has a shorter convex surface at another end portion with an elongate opening therein to receive an end of a valve stem.

9 Claims, 2 Drawing Sheets

COLD-FORMED ROCKER ARM WITH CAM-CONTACTING ROLLER

This invention relates to a cold-formed rocker arm of the cam-follower type having a cam-contacting roller rotatably mounted therein and positioned to engage a cam.

From a broad standpoint, rocker arms and other engine components have employed rollers in the past, as shown in U.S. Pat. Nos. 2,322,172 and 2,322,173 of June 15, 1943; 2,385,309 of Sept. 18, 1945; 2,506,566 of May 9, 1950; 3,139,870 of July 7, 1964; and in some of the U.S. and foreign patents cited in copending application Ser. No. 894,066; filed Aug. 7, 1986 now U.S. Pat. No. 4,697,473 of Oct. 6, 1987.

The rocker arm in accordance with the invention is of the cam-follower type and is made by cold-forming operations, including stamping, coining, staking, and back-packing. The rocker arm includes a one-piece metal body which is of U-shaped cross section substantially throughout its length. The body has a bottom wall with two structurally-integral side walls extending upwardly therefrom throughout most of its length. The rocker arm body includes a pivot pin at one end portion with a rounded lower end to receive an upper end of a lifter post on which the rocker arm can pivot. Another end portion of the rocker arm body has a short convex surface with an elongate opening therein to receive an end of a valve stem. An intermediate portion of the bottom wall is generally convex, facing downwardly. A middle portion of that convex portion has a rectangular opening extending therethrough with the length or longitudinal dimension thereof being less than the length of the convex portion so that the convex portion extends beyond both ends of the rectangular opening. The width or transverse dimension of the rectangular opening is substantially equal to the width of the bottom wall so that the rectangular opening extends substantially completely from one side wall of the rocker arm body to the other.

A cam-contacting roller is rotatably carried by the side walls of the rocker arm body and has a circumferential surface extending upwardly above the rectangular opening and positioned to engage a cam. The cam-contacting roller is mounted on an axle carried by the side walls of the body above the rectangular opening. The roller is rotatably mounted on the axle by a multiplicity of needle bearings to provide minimal friction. Part of the circumference of the roller extends downwardly into the rectangular opening to reduce the overall height of the rocker arm and achieve a lower profile.

The rocker arm with the cam-contacting roller has a number of advantages over rocker arms heretofore known. The rocker arm can have a lower profile than similar rocker arms heretofore employed, such as that shown in a copending application, Ser. No. 465,163, filed Feb. 9, 1983 now U.S. Pat. No. 4,738,231 of Apr. 19, 1988. The lower profile and compactness enables the new rocker arm to be embodied in low-profile engines with lower profile valve trains. The roller also minimizes friction between the rocker arm and the cam. This results in better fuel economy or, in the alternate, higher performance for the engine. The lesser friction also results in lower loads and enables the weight of the rocker arm to be reduced because stiffness is not as important. The cam-contacting roller also results in less wear to the rocker arm because of the roller contact instead of sliding contact and, further, reduces the noise level.

It is, therefore, a principal object of the invention to provide a rocker arm of the cam-follower type having a cam-contacting roller with a circumferential surface extending upwardly therefrom to engage a cam above the rocker arm.

Another object of the invention is to provide a rocker arm with a cam-contacting roller having the advantages and features discussed above.

Other objects and advantages of the invention will be apparent from the following detailed description of a preferred embodiment thereof, reference being made to the accompanying drawings, in which.

Figure 1:
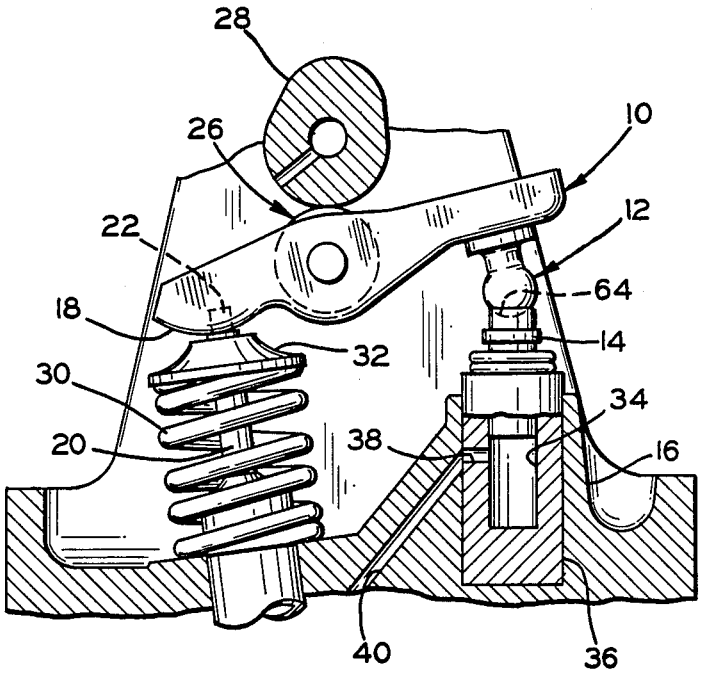
FIG. 1 is a somewhat schematic view in cross section, with portions in elevation, of valve-actuating mechanism including a rocker arm in accordance with the invention.
Figure 2:
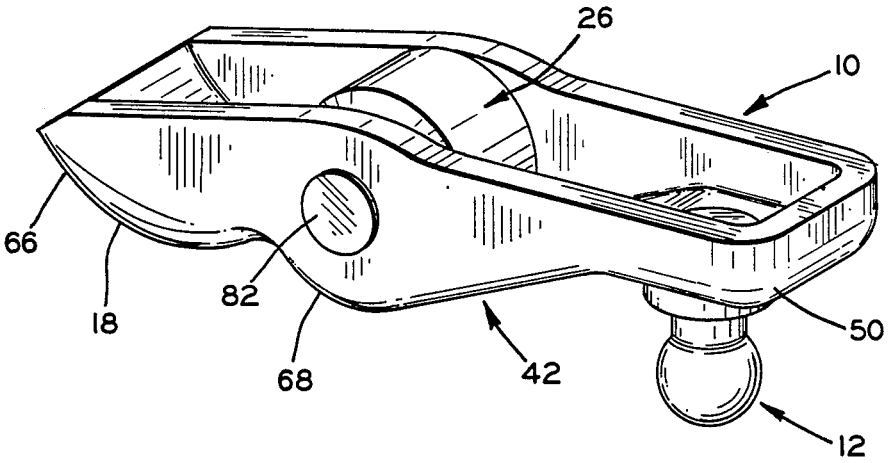
FIG. 2 is an enlarged view in perspective of the rocker arm of FIG. 1.
Figure 3:
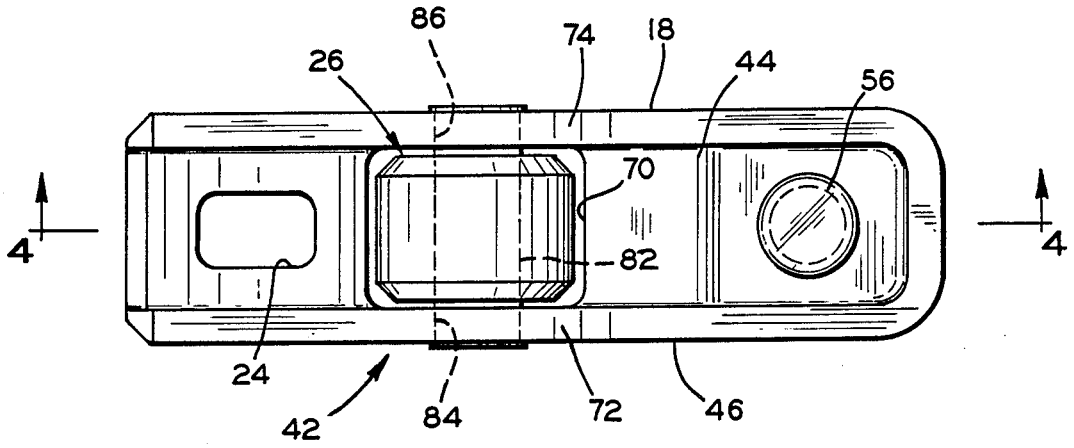
FIG. 3 is a top view of the rocker arm of FIG. 2.
Figure 4:
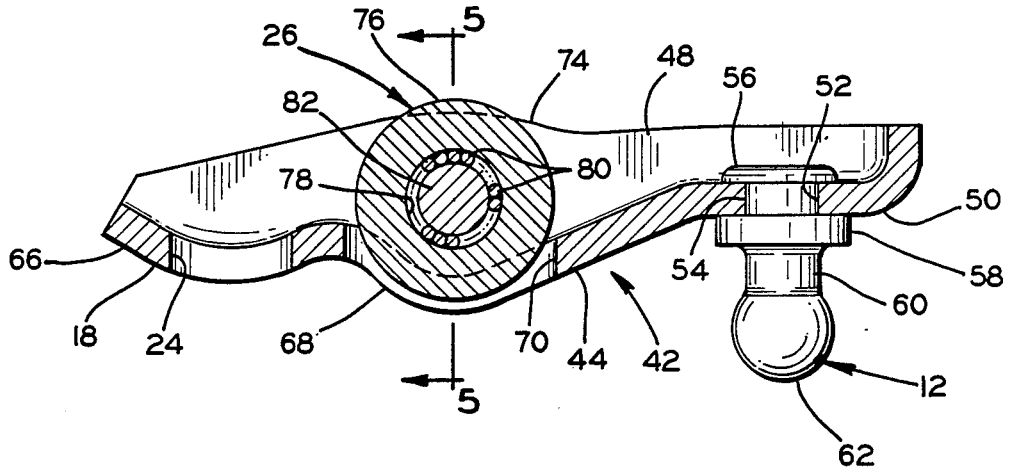
FIG. 4 is a view in longitudinal cross section taken along the line 4—4 of FIG. 3.

Referring particularly to FIG. 1, a cold-formed rocker arm of the cam-follower type in accordance with the invention as indicated at 10. The rocker arm has a downwardly-extending pin or post 12 at one end portion received in an upper end of a rocker arm fulcrum or lifter post 14 extending upwardly from a cylinder head 16 of an internal combustion engine. The other end portion of the rocker arm 10 has a short, convex end surface 18 which engages an upper end of a valve stem 20. The valve stem 20 has a smaller upper tip or projection 22 which extends through an elongate opening 24 (FIGS. 3 and 4) extending longitudinally of the convex surface 18. A cam-contacting roller 26 is rotatably carried by an intermediate portion of the rocker arm 10 and is positioned to engage an overhead cam 28.

The valve stem 20 extends upwardly from the cylinder head 16 through a coiled compression spring 30 located therearound. The spring is seated against the cylinder head and against a retainer ring 32 which is mounted on the stem 20. The rotation of the overhead cam 28 causes the rocker arm 10 to pivot on the fulcrum 14 to cause a valve (not shown) located at the lower end of the valve stem 20 to open and close as the stem is moved longitudinally by the rocker arm.

The fulcrum 14 is slidably carried in a chamber 34 of a cylinder 36. The fulcrum 14 is urged upwardly by fluid, such as oil, under pressure in the chamber 34, the oil being supplied through a small port 38 from a supply passage 40. The fulcrum 14 thereby can yield somewhat when the cam 28 rotates. In practice, the fulcrum 14 moves down slightly at the high lobe of the cam 28 to provide a zero-lash adjustment for the rocker arm 10. The port 38 is of a size to provide for controlled leakage of oil from the chamber 34 to control pressure of the oil therein.

Referring more particularly to FIGS. 2–6, the rocker arm 10 includes a one-piece, cold-formed metal body 42 which is made by cold-forming operations, such as stamping, coining, staking, and back-packing. The body 42 is of U-shaped cross section substantially throughout its length and includes a bottom wall 44 with structurally-integral, upwardly-extending side walls 46 and 48.

A first end portion 50 of the body 42 has a round hole 52 (FIG. 4) in the bottom wall 44 in which the pin 12 is affixed. For this purpose the pin 12 has a projection or tip 54 which extends through the hole 52 and is staked to form a flattened upper portion 56. The pin 12 also includes a lower flange 58 which abuts the bottom wall 44 of the rocker arm body 42. A shank 60 extends downwardly from the flange 58 and terminates in a partially spherical end 62 which forms a rounded surface received in a concave end 64 of the fulcrum 14 (FIG. 1).

A second end portion 66 of the body 42 has the end convex surface 18 with the elongate opening 24 therein. This surface is coined to maintain close tolerances in engaging the upper end of the valve stem 20. The cooperation of the elongate opening 24 and the tip 22 of the valve stem 20 prevents transverse or lateral motion of the rocker arm 10 during operation thereof.

Figure 5:
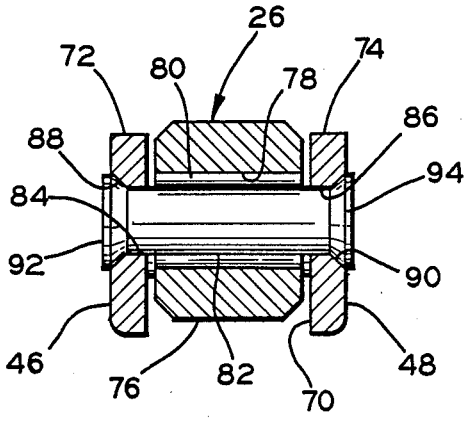
FIG. 5 is a view in transverse cross section taken along the line 5—5 of FIG. 4.
Figure 6:
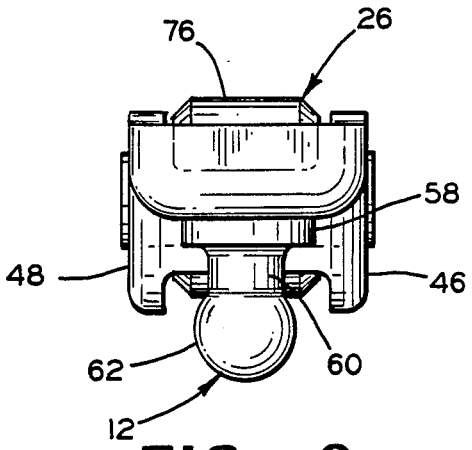
FIG. 6 is a right-end view of the rocker arm.

An intermediate portion 68 of the rocker arm body 42 is generally convex, facing downwardly, and has a rectangular opening 70 formed in the bottom wall 44 at the central area of the convex portion 68. The length or longitudinal dimension of the opening 70 is shorter than the longitudinal extent of the convex portion 68 so as to leave part of the convex portion 68 at an end of the rectangular opening 70. The width or transverse dimension of the rectangular opening 70 is substantially equal to the width of the bottom wall 44 so as to extend substantially completely between the inner surfaces of the side walls 46 and 48, as best shown in FIG. 5.

The rectangular opening 70 provides clearance for the circumference of the cam-contacting roller 26. This enables the rocker arm to have a lower profile and increased compactness which enables the rocker arm to be more readily employed in lower-profile engines with lower profile valve trains. The roller itself minimizes friction between the rocker arm and the cam to improve fuel economy or, alternatively, to achieve higher performance for the engine. The lesser friction also results in lower loads and enables the weight of the rocker arm to be reduced because stiffness is not as important. The cam-contacting roller also results in less wear to the rocker arm because of the rolling contact in place of sliding contact of the rocker arms heretofore known. Further, the noise level is reduced during operation of the engine.

The upper edges of the side walls 46 and 48, at the longitudinal edges of the rectangular opening 70, are not straight but curve upwardly at 72 and 74 (FIGS. 3 and 4) to a mid-point of the longitudinal edges of the opening 70. This provides greater height of the side wals 46 and 48 and a greater cross-sectional area of the rocker arm body 42 at the convex portion 44 where the opening 70 is located, in order to provide more strength and stiffness even though metal at the central portion of the bottom wall 44 is removed to form the opening 70.

The cam-contacting roller 26 is positioned between the side walls 46 and 48 above the opening 70 and had a circumferential surface 76 which extends slightly above the curved portions 72 and 74 of the side walls 46 and 48. The roller 26 has a central bore 78 which receives and contains a multiplicity of needle bearings 80. These rotatably support the roller 26 on an axle 82 which constitutes an inner race for the needle bearings.

The axle 82 is received in two aligned holes 84 and 86 which are formed or pierced in the side walls 46 and 48. The outer ends of the holes 84 and 86 are flared at 88 and 90 to receive enlarged or flared ends 92 and 94 of the axle 82 to prevent longitudinal movement of the axle.

Various modifications of the above-described embodiment of the invention will be apparent to those skilled in the art and it is to be understood that such modifications can be made without departing from the scope of the invention, if they are within the spirit and the tenor of the accompanying claims.

We claim:

1. In combination, a lifter post, a valve stem spaced from said lifter post, an overhead cam, and a cold-formed rocker arm of the cam-follower type comprising a one-piece metal body of generally U-shaped cross section throughout most of its length, said body having a bottom wall and two side walls extending upwardly therefrom and structurally integral therewith, said bottom wall having a rectangular opening at an intermediate portion thereof, said rectangular opening extending substantially the width of said bottom wall between the side walls and having a length which is less than the length of the bottom wall, said metal body having a pin with a downwardly-extending spherical portion at one end portion of said body, said spherical portion being received in an end of said lifter post on which said rocker arm can pivot, said body having a surface at a second end portion thereof with an opening extending therethrough receiving an end of said valve stem, said side walls of said body having axially-aligned openings therein above said rectangular opening, an axle extending through said aligned openings and affixed to said side walls to prevent longitudinal movement of said axle, a roller located around said axle and extending between the side walls of said body, bearing means around said axle and within a bore of said roller to enable said roller to be rotatably mounted on said axle, and a portion of a circumferential surface of said roller projecting upwardly above the upper edges of said side walls and engaging said cam.

2. The combination according to claim 1 characterized by said bottom wall of said body being convex at the intermediate portion and extending downwardly below the circumferential surface of said roller.

3. The combination according to claim 1 characterized by upper edges of said side walls of said body above said rectangular opening curving upwardly to increase the height of said side walls at middle portions of the longitudinal edges of said rectangular opening.

4. A cold-formed rocker arm of the cam-follower type comprising a one-piece metal body of generally U-shaped cross section throughout its length, said body having a bottom wall and two side walls extending upwardly therefrom and structurally integral therewith, said bottom wall having a pin-receiving hole in a first end portion thereof, a pin having a projection extending upwardly through said hole and flared over to affix said pin to said bottom wall, said pin having a flange adjacent the lower surface of said bottom wall and having a rounded portion extending downwardly therefrom to receive an end of a lifter post, said bottom wall having a downwardly-facing end convex portion at a second end thereof, said body having an intermediate generally convex portion facing downwardly, said bottom wall having a rectangular opening therein at the convex portion and extending substantially the width of said bottom wall between said side walls, said side walls of said body having axially-aligned openings therein above said rectangular opening, an axle extending through said aligned openings and affixed to said side walls to prevent longitudinal movement of said axle, a roller located around said axle and extending substantially between the side walls of said body, bearing means around said axle and within a bore of said roller to enable said roller to be rotatably mounted on said axle, a portion of a circumferential surface of said roller projecting into said rectangular opening, and a portion of the circumferential surface of said roller projecting upwardly above said rectangular opening to engage a cam.

5. A cold-formed rocker arm according to claim 4 characterized by upper edges of said side walls of said body above said rectangular opening curving upwardly to increase the height of said side walls at middle portions of the longitudinal edges of said rectangular opening.

6. A cold-formed rocker arm according to claim 4 characterized by said bottom wall having an elongate opening at said end convex portion to receive a tip portion of a valve stem.

7. A cold-formed rocker arm of the cam-follower type comprising a one-piece metal body of generally U-shaped cross section throughout its length, said body having a bottom wall and two side walls extending upwardly therefrom and structurally integral therewith, said bottom wall having a first end portion to which a pin is affixed, said pin having a rounded portion extending downwardly to receive an end of a lifter post, said bottom wall having a downwardly-facing end convex portion at a second end thereof, said bottom wall having an elongate opening at said convex portion extending longitudinally of said metal body to receive a tip portion of a valve stem, said body having an intermediate generally convex portion facing downwardly, said bottom wall having a rectangular opening therein at the convex portion, said side walls of said body having axially-aligned openings therein above said rectangular opening, an axle extending through said aligned openings and affixed to said side walls to prevent longitudinal movement of said axle, a roller located around said axle and extending substantially between the side walls of said body, bearing means around said axle and within a bore of said roller to enable said roller to be rotatably mounted on said axle, and a portion of a circumferential surface of said roller projecting upwardly above said rectangular opening to engage a cam.

8. A cold-formed rocker arm according to claim 7 characterized by said bottom wall having a pin-receiving hole in the first end portion, said pin having a projection extending upwardly through said hole and flared over to affix said pin to said bottom wall.

9. A cold-formed rocker arm according to claim 8 characterized further by said pin having a flange adjacent the lower surface of said bottom wall and having a shank connecting said flange and said rounded portion of said pin.

* * * * *